United States Patent [19]

McGee

[11] Patent Number: 5,004,167

[45] Date of Patent: Apr. 2, 1991

[54] PNEUMATIC GRINDING MILL

[76] Inventor: Dwight H. McGee, 304 Oakridge Blvd., Lynchburg, Va. 24502

[21] Appl. No.: 429,007

[22] Filed: Nov. 29, 1989

[51] Int. Cl.[5] ..... B02C 13/28

[52] U.S. Cl. ..... 241/91; 241/154; 241/188 R

[58] Field of Search ..... 241/5-13, 241/57, 278 R, 281.1, 281.2, 39, 195, 91, 92, 152 R, 188 R, 189 R, 154, 62

[56] References Cited

U.S. PATENT DOCUMENTS

| | | | |
|---|---|---|---|
| 769,253 | 9/1904 | Cox | 241/154 X |
| 1,752,888 | 4/1930 | Cloud | 241/154 X |
| 2,322,306 | 6/1943 | McLaren | 241/278 R X |
| 2,609,995 | 9/1952 | Klagsbrunn | 241/154 |
| 2,928,616 | 3/1960 | Smith | 241/91 X |
| 3,643,879 | 2/1972 | Palyi | 241/154 X |
| 4,520,964 | 6/1985 | Rossler | 241/92 X |
| 4,728,047 | 3/1988 | Shagarova et al. | 241/188 R X |

FOREIGN PATENT DOCUMENTS

| | | | |
|---|---|---|---|
| 815158 | 8/1951 | Fed. Rep. of Germany | 241/92 |
| 923169 | 2/1955 | Fed. Rep. of Germany | 241/154 |
| 2844164 | 4/1980 | Fed. Rep. of Germany | 241/278 R |
| 1050133 | 1/1954 | France | 241/91 |
| 991403 | 5/1965 | United Kingdom | 241/91 |

*Primary Examiner*—Mark Rosenbaum
*Attorney, Agent, or Firm*—Charles S. McGuire

[57] ABSTRACT

Milling apparatus for reducing the size of grain kernels or particles by impact with a solid surface as the grain is moved through the apparatus by an air stream created by rotation of a rotor within a stationary casing having an inlet opening at or near the center and an outlet opening at the outer periphery. The rotor comprises a circular disk having a series of elements affixed to a surface thereof in a circular configuration spaced outwardly from the center of the rotor. The elements comprise sections of hollow steel tubing of rectangular cross section or toothed blades so arranged that grain traveling radially outwardly from the inlet to the outlet opening of the casing impact with the elements with a force sufficient to break the grain. The particles may be passed through additional rotor stages, and the particle size or texture of the final product may be controlled by the speed of rotor rotation and the number of rotor stages through which the grain is passed.

5 Claims, 4 Drawing Sheets

PNEUMATIC GRINDING MILL

BACKGROUND OF THE INVENTION

The present invention relates to milling apparatus for reducing the size of grain kernels and, more specifically, to such apparatus wherein grain is moved by an air stream created by rotation of a rotor having surfaces which impact with the grain to effect the desired size reduction.

Grain has traditionally been ground by rolling, hammer and grist mills. The prior art also includes means for breaking grain kernels by impact with a stationary or moving surface. For example, U.S. Pat. No. 2,512,523 discloses an impeller-type mill wherein corn kernels are broken to separate the oil-carrying germ by projecting the kernels with a vane impeller against the outer surface of a rotating wheel or drum. Other patents directed to comminuting or breaking materials other than grain by impact with a surface or object are U.S. Pat. Nos. 2,976,717, 3,995,784, 4,133,487 and 4,575,013.

It is a principal object of the present invention to provide milling apparatus for reducing the size of grain which operates on far less power than that required by a conventional rolling mill of comparable capacity.

Another object is to provide grain milling apparatus which is of small size relative to its capacity, requiring only a fraction of the space normally occupied by a rolling mill capable of processing grain at the same rate.

A further object is to provide novel grain milling apparatus having the foregoing advantages of low power and small space requirements relative to its capacity, yet versatile in operation, being capable of grinding virtually any type of material normally encountered in milling operations.

Still another object is to provide a novel form of grain milling apparatus which is relatively simple in construction and extremely durable in operation, often requiring no parts replacements for several years of continuous operation.

Other objects will in part by obvious and will in part appear hereinafter.

SUMMARY OF THE INVENTION

In accordance with the foregoing objects, the milling apparatus of the present invention includes a rotor structure wherein a circular, disk-like member is rotated within an enclosed housing having an inlet opening concentric with the axis of rotation, and a peripheral outlet opening. In a first disclosed embodiment, a plurality of tubular members, open at both ends and preferably of rectangular cross section, are affixed in continuous, adjacent relation to a surface of the circular disk. The tubular members are spaced radially outwardly from the center of the disk, preferably around the periphery thereof and so arranged with respect to the circular disk, and housing that material passing from the inlet to the outlet must pass through one of the tubular members. In another embodiment, the tubular members are replaced by toothed blades affixed to the circular member.

The housing inlet is connected to a bin or other source of the whole grain or other such material to be operated upon by the milling apparatus. Rotation of the rotor structure creates a moving stream of air flowing from inlet to outlet of the housing and thus through the tubular members, or around the toothed blades. The grain is carried by the air stream along this path and, as it moves in a radial direction, impacts sharply with inner surfaces of the rotating tubular members or toothed edges of the blades. At suitable rotational speeds, e.g., 1800 rpm with a 32" diameter rotor, the grain is broken by the impact.

In addition to the two embodiments of the impact members, the rotor structure and surrounding housing are also disclosed in two embodiments, providing different flow paths for the grain.

In one embodiment, after entering the axial inlet and traveling radially through the impact members affixed to the disk, the grain passes into an annular space within the housing surrounding the outer periphery of the rotor structure. The grain particles then travel radially inwardly on the opposite side of the disk and through an opening around the axis of rotation in a dividing wall into a second compartment of the housing which contains a second rotor structure. The second rotor also includes a circular disk with impact members (open, tubular members or toothed blades) affixed thereto, and may be identical in size and construction to the first rotor structure, mounted for rotation about the same axis. The grain is normally reduced further in size as it passes through and impacts with the impact members of the second rotor structure. If desired, the grain may be passed through additional housing and rotor stages to achieve the desired consistency of the final product.

In another disclosed embodiment, the rotor structure is formed by a single circular disk with impact members affixed to both sides, arranged within a stationary, cylindrical housing separated into two, side-by-side compartments by the circular disk. A small clearance is provided between the outer periphery of the rotor blade and the stationary portion of the housing. The grain is moved by the air stream successively through the first and second housing compartments, which are connected by external conduits, for impact with the two sets of impact members on opposite sides of the single circular disk. Additional, coaxial stages of two-compartment housings with single rotor structures may be provided, if desired.

DETAILED DESCRIPTION

Figure 2:
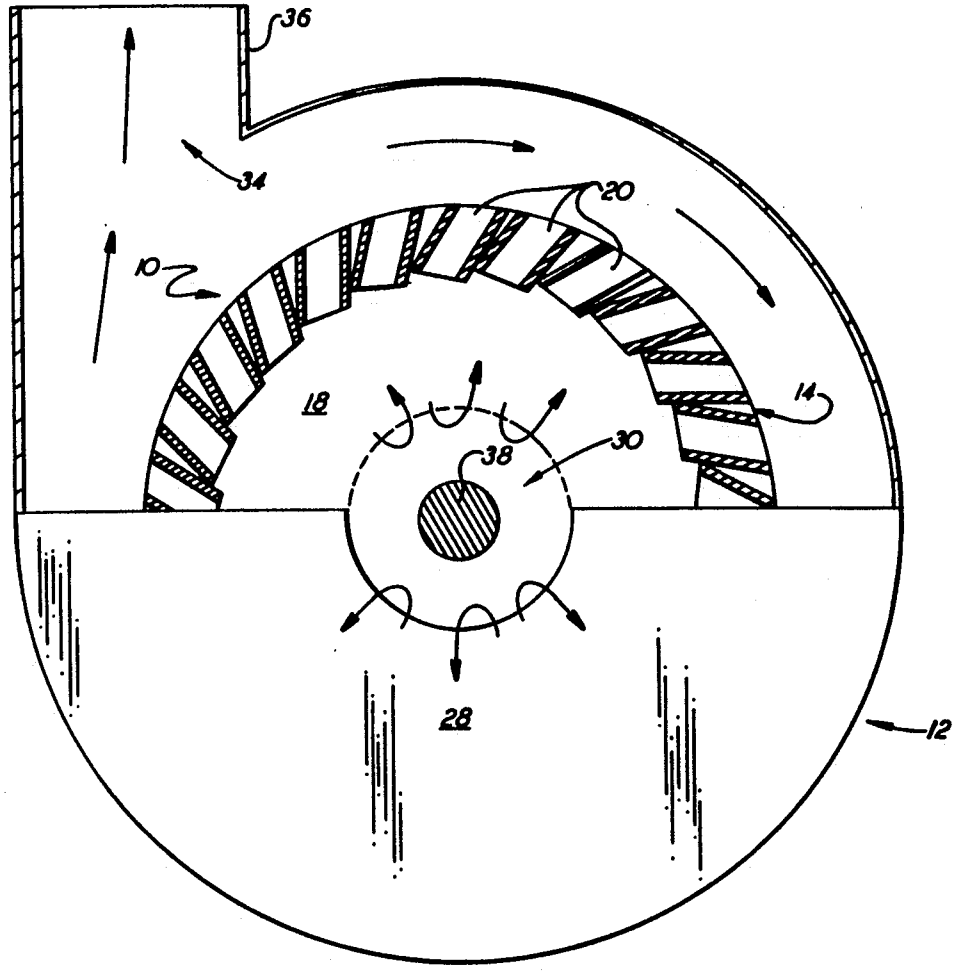
FIG. 2 is a side elevational view of the apparatus of FIG. 1, taken on the line 2—2 thereof.
Figure 1:
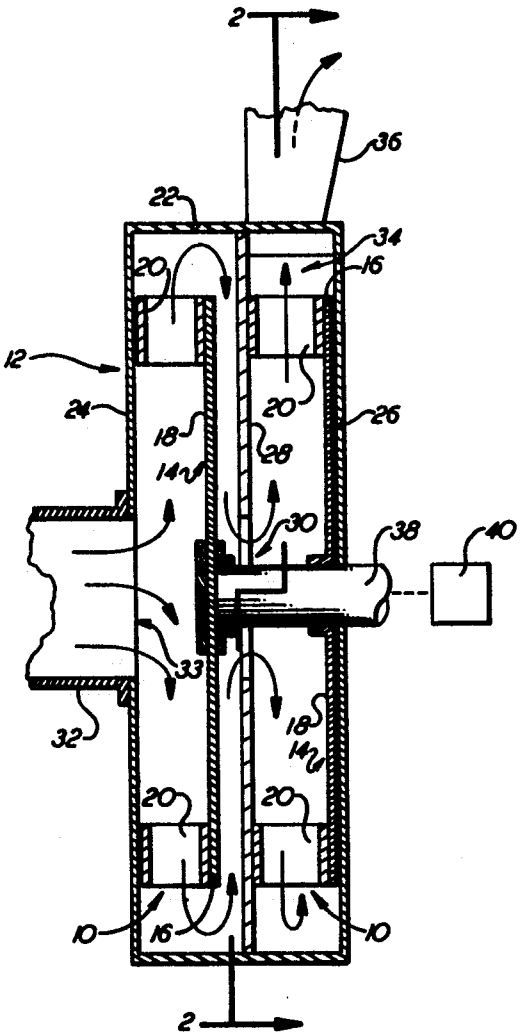
FIG. 1 is a fragmentary, front elevational view in vertical half-section, showing principal elements of the milling apparatus of the invention, and illustrating the operation thereof, in a first embodiment.

Referring now to the drawings, in FIGS. 1 and 2 a first embodiment of the milling apparatus of the invention, including rotor structures and a housing generally denoted by reference numerals 10 and 12, respectively, is shown. Rotor structures 10, two of which are seen in FIG. 1, each include circular blade or disc 14, having outer, peripheral edge 16 and surface 18 to which are fixedly attached a plurality of tubular members 20, open at both ends. Since the two rotor structures 10 may be of essentially identical constructions, common reference numerals are used to denote the various portions thereof. Tubular members 20 are preferably formed from steel tubing of rectangular cross section and, as seen in FIG. 2, are arranged in immediately adjacent relation to one another about the outer periphery of blade 14.

Housing 12 includes cylindrical side wall 22 and flat end walls 24 and 26, as well as interior wall 28 by which the housing is divided into two compartments. Wall 28 engages the inside of side wall 22 about its periphery and includes central opening 30, through which the two housing compartments communicate. Inlet pipe or tube 32 is affixed to housing end wall 24 about central opening 33 therein, whereby tube 32 communicates with the interior of the housing compartment shown on the left-hand side in FIG. 1. The housing compartment shown on the right-hand side communicates through opening 34 in side wall 22 with upwardly directed outlet tube 36.

Drive shaft 38 extends from a suitable power drive means, indicated diagrammatically at 40, which may comprise an electric motor or gasoline engine or, for that matter, a wind or water-powered drive means. Shaft 38 extends through an opening in wall 26 of housing 12 with a close clearance, a seal and/or bearing being provided, if desired, and through opening 30 in interior wall 28. Circular disks 14 are fixedly attached to shaft 38 within the left and right compartments of housing 12 for rotation of rotor structures 10 by the drive shaft. A suitable speed control means may be associated with drive means 40, or may be provided between drive means 40 and rotors 10 in conventional manner, as for example by gears, clutch, etc.

When rotation is imparted to rotors 10, a moving air stream is created, flowing into, through and out of housing 12 as indicated by the arrows. Grain kernels or particles to be reduced in size by the milling apparatus of the invention are carried by the air stream into the housing compartment on the left-hand side in FIG. 1, and moved radially outwardly, passing through tubular members 20. The radially moving grain particles collide with inner surfaces of tubular members 20, and are broken by the force of the impact.

The particles are then drawn by the air stream around peripheral edge 16 of the left-hand rotor blade, and move radially inwardly, through opening 30 and into the housing compartment on the right-hand side in FIG. 1. Once inside the second compartment the particles again travel radially outwardly to pass through tubular members 20 of the rotor therein, impacting with surfaces of the tubular members and thus being further reduced in size. The comminuted particles then pass out of housing 12 through outlet opening 34 and tube 36, and may then be further processed as desired, including passage through one or more additional rotor stages if further size reduction is required.

Figure 3:
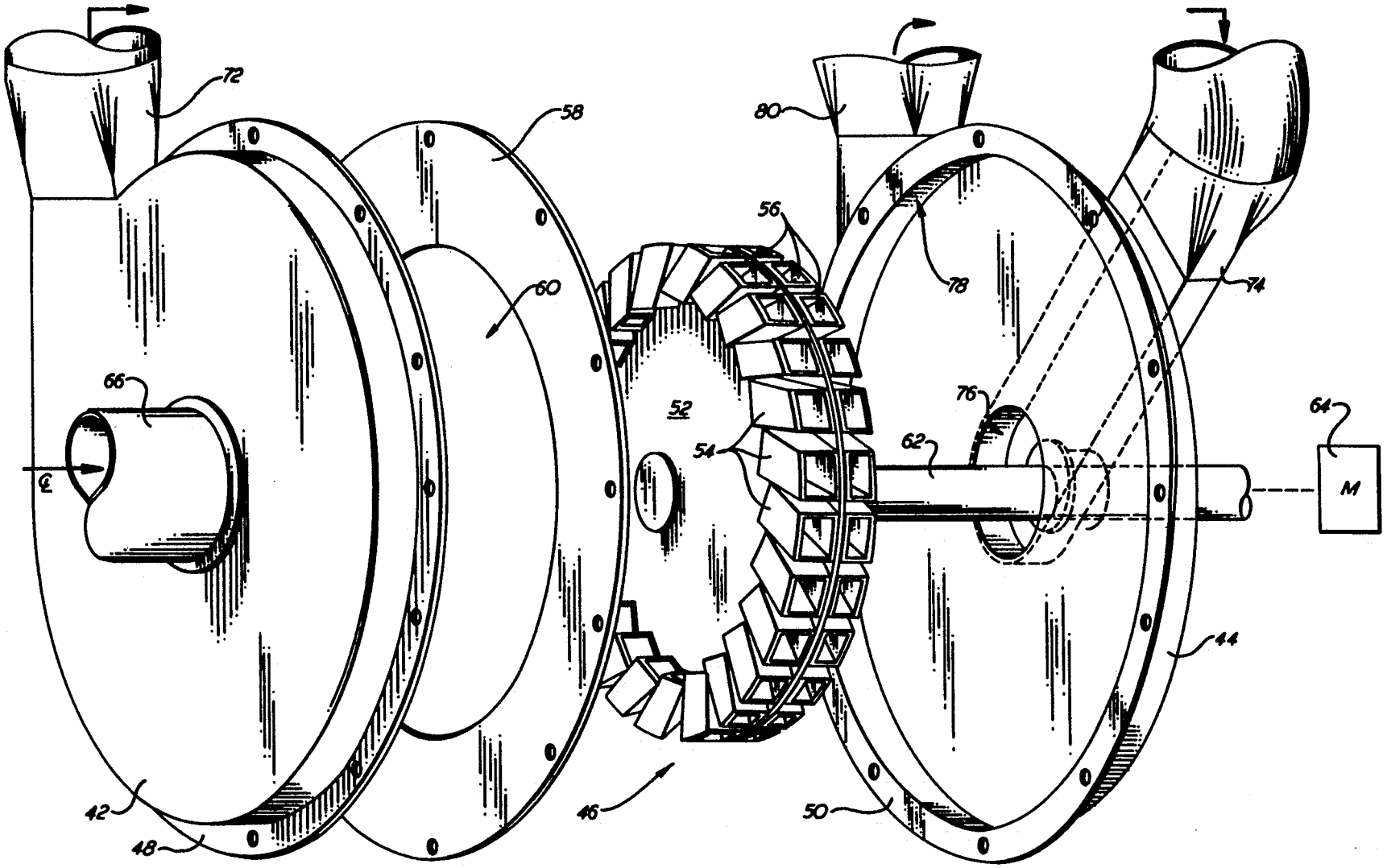
FIG. 3 is an exploded perspective view of a second embodiment of the apparatus.
Figure 4:
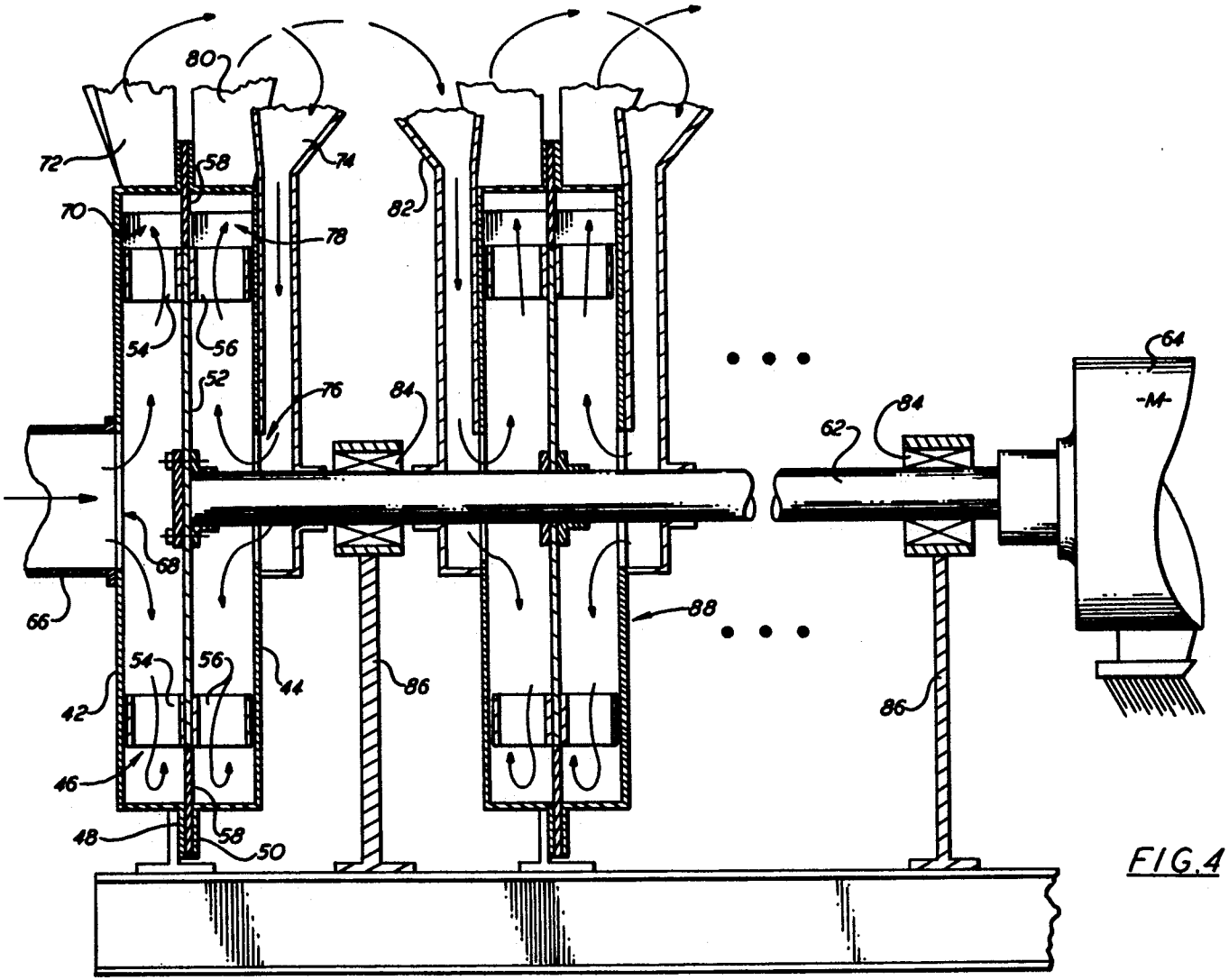
FIG. 4 is a front elevational view, in vertical half-section, of the apparatus of FIG. 3, with additional stages.

Turning now to FIGS. 3 and 4, a second embodiment of the milling apparatus is shown. The elements illustrated in exploded perspective in FIG. 3 include left and right housing portions 42 and 44, respectively, and a rotor structure denoted generally by reference numeral 46. Housing portions 42 and 44 are joined to form an enclosure for rotor 46 by means of bolts (not shown) passing through openings in flanges 48 and 50 of housing portions 42 and 44, respectively. Rotor 46 comprises circular disk 52 and first and second pluralities of tubular members 54 and 56 fixedly attached to opposite surfaces of blade 52 about the outer periphery thereof.

Intermediate wall member 58 is retained between flanges 48 and 50, and includes central, circular opening 60 having a diameter only slightly larger than that of rotor blade 52. The latter is fixedly supported on the end of drive shaft 62, which is connected to motor 64. Rotor 46 is positioned within the housing substantially centrally thereof, with disk 52 coplanar with wall member 58 which thus cooperate to separate the housing into separate compartments which communicate only through the small clearance between the inner and outer peripheries of opening 60 and blade 52, respectively.

The bin or other source of grain to be reduced in size by the milling apparatus communicates through tube 66 with opening (FIG. 4) in housing portion 42, and thus with the left-hand compartment of the housing. The grain travels radially outwardly, through tubular members 54, being broken by impact with surfaces of the rotating members, and passes out of the left-hand compartment through opening 70, into tube 72 which communicates with tube 74. The latter passes down the outside of right housing portion 44 and communicates through opening 76 with the right-hand compartment of the housing.

The grain particles entering the right-hand compartment travel radially outwardly, passing through tubular members 56, being further reduced in size by impact therewith. The grain particles pass out of the right-hand compartment through opening 78 and into tube 80. If further size reduction is required, tube 80 may be connected to the inlet 82 of an additional rotor stage which, as shown in FIG. 4, may be driven by the same drive shaft 62. Suitable bearings 84 on pedestals 86 are provided as required along the length of drive shaft 62.

The second (and any additional) rotor stage may be essentially identical to the first, and is therefore generally denoted by reference numeral 88, rather than duplicating the description of individual elements. As in the previous embodiment, the grain or grain particles are moved entirely by the air stream flowing outwardly from the center of the housing compartments produced by rotation of the rotor structures. The velocity of the moving grain is a function of particle size, as well as the rotational speed of the rotor(s). A suitable rotational velocity for many applications is about 1,800 rpm when using rotor structures 32 inches in diameter.

After passing through the final rotor stage, the grain particles may be carried by the moving air stream to an air separator for removal of chaff or other large, low density particles, and thence through one or more sifter stages. Larger particles removed by sifting may be recycled for further size reduction, if desired.

Milling apparatus of the type disclosed is versatile, being suitable for operation with virtually any type or grain or other such products, as well as economical in both power and space requirements. As compared to a conventional rolling mill of comparable capacity, for example, capable of processing 60,000 lbs of grain in a 24 hour period, the milling apparatus of the present invention requires only about one-half as much power and occupies only a fraction of the space. Furthermore, the milling apparatus is relatively simple in design, and thus economical in construction, as well as being extremely durable in operation, requiring no parts replacement for up to several years of essentially continuous operation.

Variations in the configuration of various elements are contemplated within the scope of the invention as defined by the following claims. As an example of such variations, the members which impact with and break the grain kernels or particles need not be of tubular configuration. Plates or blades affixed to the rotor blade and having surfaces arranged in planes substantially perpendicular to the planar surface of the circular blade and arranged at appropriate intervals about the outer periphery thereof are also suitable. Such plates, as well as the disclosed tubular members, may be arranged at an angle to the rotor radius, as shown, or along radial lines. Although the efficiency may be altered by the angular arrangement of the grain-impacting members, the operating principle is the same, and satisfactory performance may be achieved with a variety of arrangements.

Figure 5:
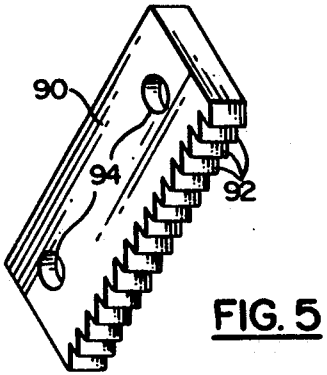
FIG. 5 is a perspective view of a second embodiment of one of the elements of FIGS. 1-4.
Figure 6:
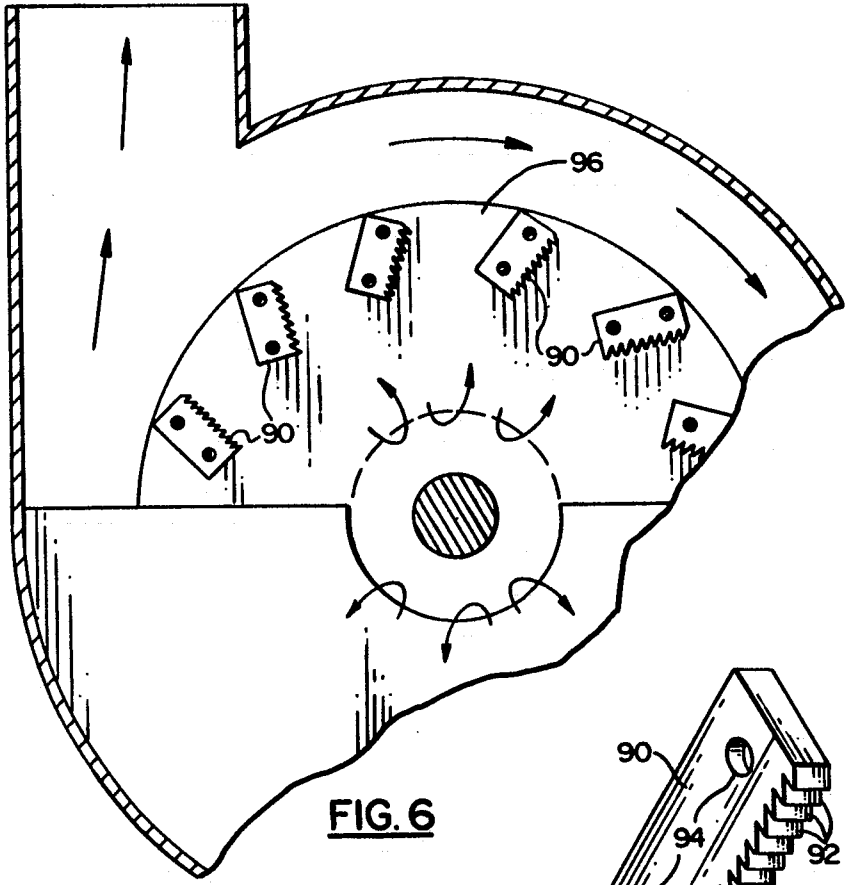
FIG. 6 is a fragmentary, side elevational view, as in FIG. 2, showing the elements of FIG. 5 incorporated therewith.
Figure 7:
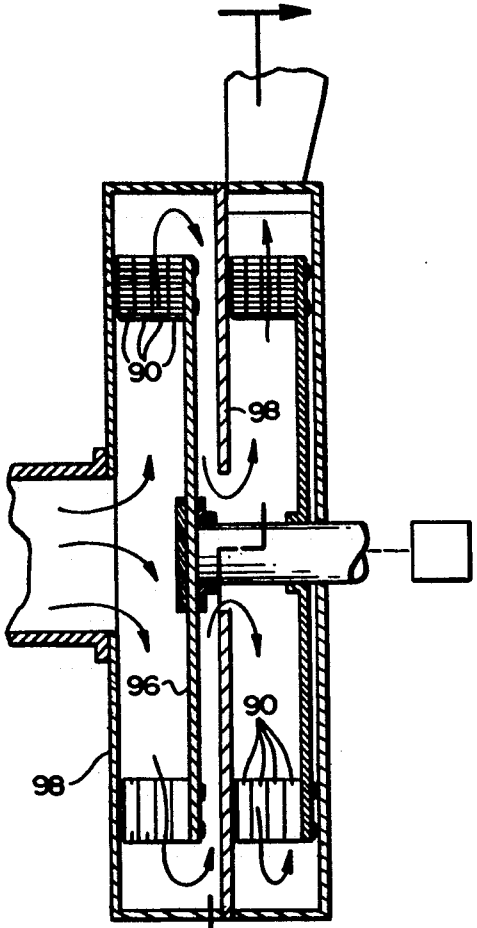
FIG. 7 is the same view as FIG. 1, with the elements of FIGS. 5 and 6 substituted for the corresponding elements of FIGS. 1-4.

An example of such an arrangement is shown in FIGS. 5–7. Blade 90 has notched teeth 92 formed along one side thereof and through openings 94 for passage of bolts which serve to affix blades 90 to circular disks 96 to provide a rotor structure such as that of FIGS. 1 and 2. A plurality of blades 90 may be stacked together and affixed to disks 96, as best seen in FIG. 7, as required to substantially fill the space between disks 96 and walls 98 of the housing. As shown in FIG. 6, the stacks of toothed blades 90 are affixed to the surface of disk 96 at spaced positions about the periphery thereof with the toothed edges at an angle to radial lines on the disk. In such arrangements, the texture of the grind is determined by the number of teeth per inch on the blades; the capacity of the unit is determined by the total thickness of the stacked blades.

What is claimed is:

1. Multi-stage milling apparatus for reducing the size of grain kernels and particles comprising:

(a) substantially cylindrical housing means including first and second, flat, circular end walls joined by a cylindrical side wall, and a flat, circular interior wall, parallel to and between said first and second end walls dividing the interior of said housing means into first and second, side-by-side compartments;

(b) first and second rotor means respectively positioned within said first and second compartments, each of said rotor means including a single, flat, circular plate and a plurality of open-ended metal tubes of rectangular cross section having a surface perpendicular to said rigid surface in contact with said one side of said rotor plates, said tubes being fixedly attached to and supported solely by one side of said plate in closely spaced relation about the periphery thereof, each of said tubes having a rigid surface substantially perpendicular to said one side of said plate;

(c) a product inlet conduit connected to said first end wall and communicating with said first compartment through an opening in and concentric about the central axis of said first end wall;

(d) a drive shaft connected to rotary drive means and extending through openings in and concentric about the central axis of each of said second end wall, said second rotor plate, and said interior wall, said drive shaft being fixedly connected to both said first and second rotor plates, said second end wall and second rotor plate openings being substantially the same diameter as said drive shaft and said interior wall opening being substantially larger than the diameter of said drive shaft, whereby said first and second compartments communicate through said interior wall opening;

(e) said first rotor means being supported by said drive shaft within said first compartment with said first rotor plate parallel to and spaced from both said first end wall and said interior wall with said tubes extending from said first rotor plate substantially to said first end wall, said first rotor plate having a diameter less than that of said cylindrical side wall, providing a first annular space between the periphery of said first rotor means and said cylindrical side wall;

(f) said second rotor means being supported by said drive shaft within said second compartment with said second rotor plate parallel to and closely adjacent said second end wall within said tubes extending from said second rotor plate substantially to said interior wall, said second rotor plate having a diameter less than that of said cylindrical side wall, providing a second annular space between the periphery of said second rotor means and said cylindrical side wall; and (g) a product outlet conduit communicating with said second annular space through an opening in said cylindrical side wall, rotation of said first and second rotor means by said drive shaft creating an air stream drawing product from said inlet conduit into said first compartment for impact with said first rotor plate and radially outward movement for impact with said perpendicular surface of said first rotor tubes, into said first annular space, through the space between said first rotor plate and said interior wall, through said interior wall opening into said second compartment for impact with said second rotor plate and radially outward movement for impact with said perpendicular surface of said second rotor tubes, into said second annular space and thence into and through said outlet conduit.

2. The invention according to claim 1 wherein said tubes are of equal length, each tube having an outer end substantially coextensive with the periphery of the associated rotor plate and an inner end in contact with the adjacent tubes on both sides.

3. Multi-stage milling apparatus for reducing the size of grain kernels and particles comprising:

(a) substantially cylindrical housing means including first and second, flat, circular end walls joined by a cylindrical side wall, and a flat, circular interior wall, parallel to and between said first and second end walls, said interior wall having an outer periphery joined to said cylindrical side wall and a circular opening defined an internal periphery of predetermined diameter;

(b) rotor means including a single flat, circular plate of substantially said predetermined diameter, and first and second pluralities of impact members respectively attached to and supported solely by opposite sides of said plate in closely spaced relation about the periphery thereof, each of said impact members having a rigid surface substantially perpendicular to and extending outwardly from said plate;

(c) a drive shaft connected to rotary drive means and extending through an opening in and concentric about the central axis of said second end wall, said drive shaft being fixedly connected to said rotor plate to support the latter with its periphery closely confined within said internal periphery of said interior wall, whereby said interior wall and said plate cooperatively divide the interior of said housing means into first and second, side-by-side compartments;

(d) a product inlet conduit connected to said first end wall and communicating with said first compartment through an opening in and concentric about the central axis of said first end wall;

(e) said first plurality of impact members extending substantially from said rotor plate to said first end wall within said first compartment, and said second plurality of impact members extending substantially from said rotor plate to said second end wall within said second compartment;

(f) a product transfer conduit communicating at one end with said first compartment through an opening in said cylindrical side wall and at the other end with said second compartment through said second end wall opening, the latter having a diameter significantly larger than that of said drive shaft passing therethrough; and (g) a product outlet conduit communicating with said second compartment through an opening in said cylindrical side wall, rotation of said rotor means by said drive shaft creating an air stream drawing product from said inlet conduit into said first compartment for impact with said rotor plate and radially outward movement for impact with said first plurality of impact members, through said product transfer conduit, through said second end wall opening and into said second compartment for impact with said rotor plate and radially outward movement for impact with said second plurality of impact members, and thence into and through said outlet conduit.

4. The invention according to claim 3 wherein said first and second pluralities of impact members each comprise hollow, open-ended, metal tubes of rectangular cross section having a surface perpendicular to said rigid surface in contact with said rotor plate.

5. The invention according to claim 3 wherein said tubes are of equal length, each tube having an outer end substantially coextensive with the periphery of said rotor plate and an inner end in contact with the adjacent tubes on both sides.

* * * * *